United States Patent [19]

Weitzler

[11] Patent Number: 4,907,307

[45] Date of Patent: Mar. 13, 1990

[54] SUPPORT STRUCTURE

[76] Inventor: David A. Weitzler, 25 Fraser Rd., Framingham, Mass. 01701

[21] Appl. No.: 163,031

[22] Filed: Mar. 2, 1988

[51] Int. Cl.[4] ..... A47C 27/08

[52] U.S. Cl. ..... 5/449; 5/450; 5/451; 5/455

[58] Field of Search ..... 5/258, 449–451, 5/453, 455, 468; 441/1, 129–132

[56] References Cited

U.S. PATENT DOCUMENTS

| | | | |
|---|---|---|---|
| 2,434,641 | 1/1948 | Burns | 5/449 X |
| 3,310,818 | 3/1967 | Fischer | 5/453 X |
| 3,748,669 | 7/1973 | Warner | 5/450 |
| 3,879,770 | 4/1975 | Solen | 5/450 X |
| 4,296,510 | 10/1981 | Phillips | 5/451 X |
| 4,345,348 | 8/1982 | Hall | 5/450 |

*Primary Examiner*—Michael F. Trettel

*Attorney, Agent, or Firm*—John E. Toupal; Harold G. Jarcho

[57] ABSTRACT

A support structure for use with a fluid medium and including a base for disposition in a given position; first and second buoys both buoyant in the fluid medium, the first buoy adapted for support by the fluid medium in another position displaced from the given position, and the second buoy adapted for support by the fluid medium in a different position displaced from both the given and another positions; an anchor mechnism securing the base to the first buoy so as to permit closure movement therebetween while maintaining a given maximum displacement therebetween; and a mooring mechanism securing the first buoy to the second buoy and adapted to maintain a predetermined maximum spacing therebetween while permitting relative closure movement therebetween.

17 Claims, 5 Drawing Sheets

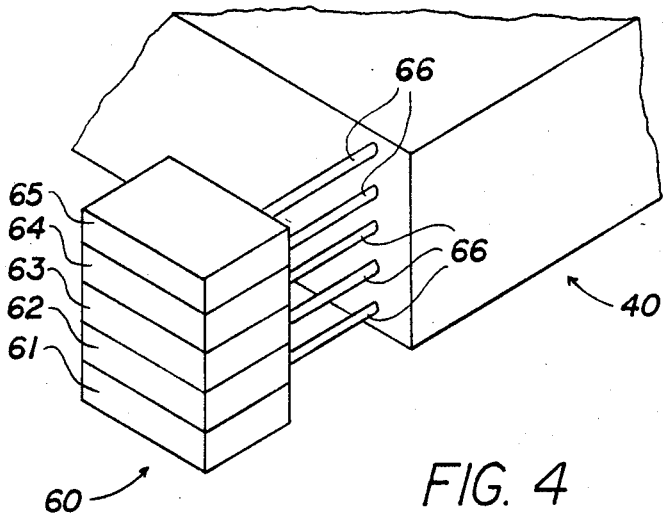
FIG. 4
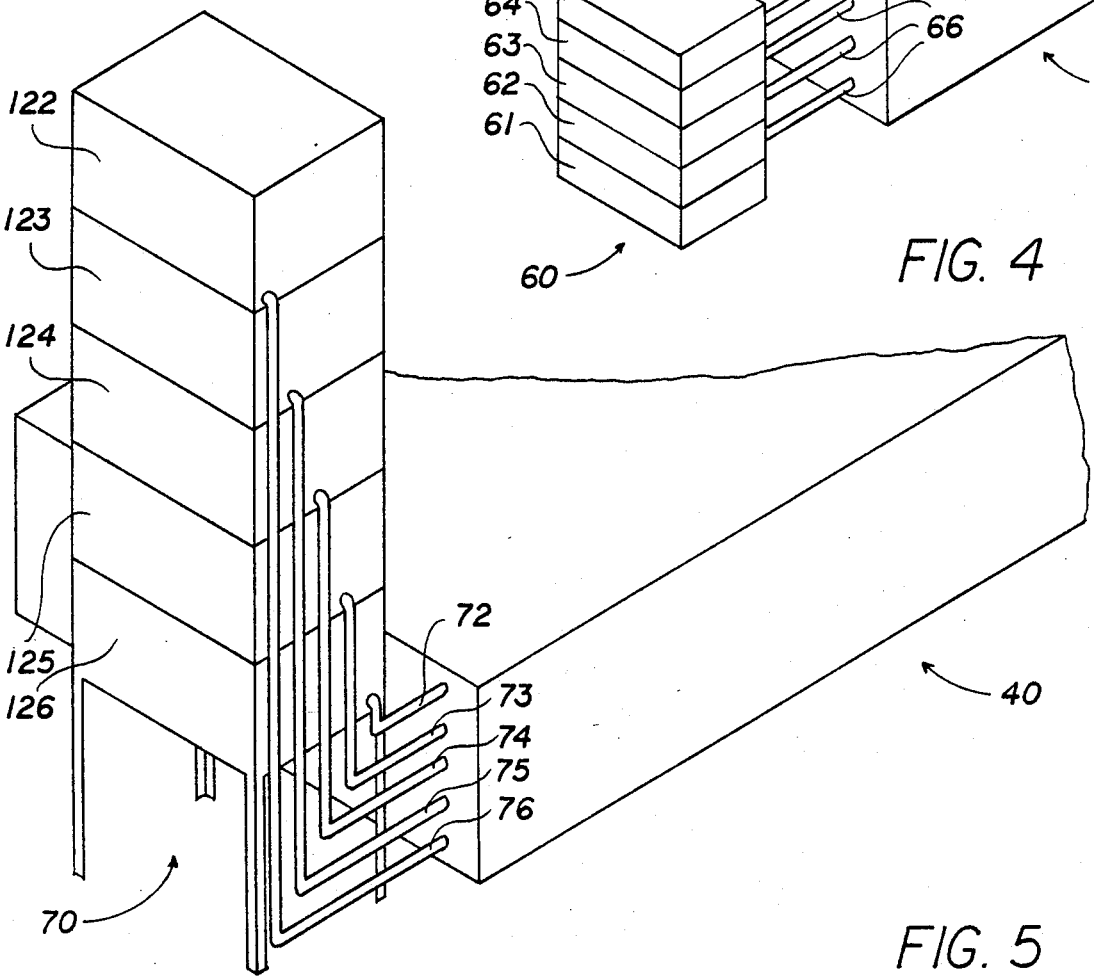
FIG. 5
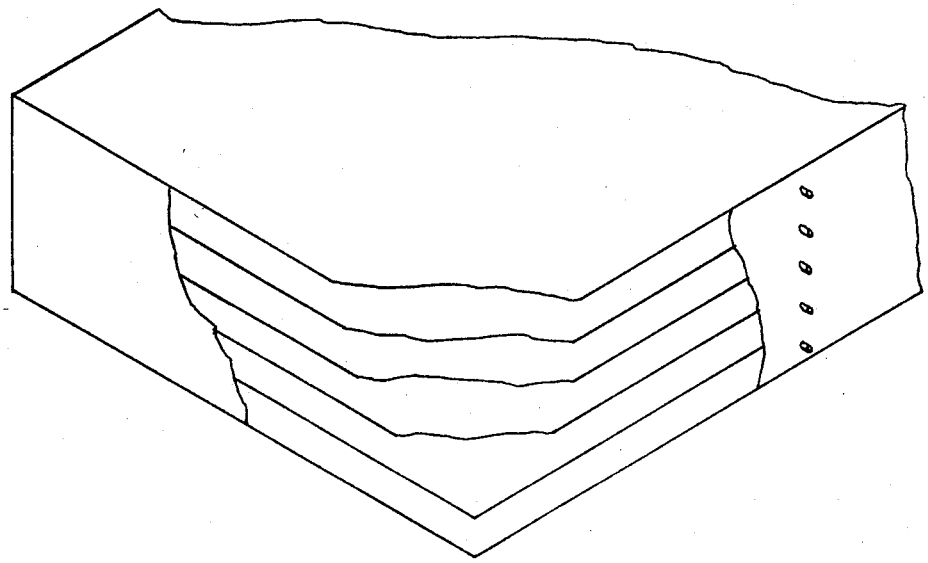

SUPPORT STRUCTURE

BACKGROUND OF THE INVENTION

This invention relates generally to a support structure for objects and, more particularly, to a support structure in which an object is supported by interconnected arrays of members buoyant in a fluid medium.

Water filled vinyl bags or "waterbeds" are used extensively as mattresses. Basically, they provide a degree of comfort which had previously been unrealized. Although very popular, however, the waterbed exhibits drawbacks that are very apparent.

When using a waterbed one tends to bounce on dynamic waves and bind upon the static waveform which compliments one's body. The taut skin of a waterbed does the damage; firstly, by amplifying the inner water's natural wave and hence sea-sickness producing surface tension and secondly, by supplementing the support of a uniform inner pressure near deeply penetrated areas with a binding tangential friction between the taut skin and one's body. Other disadvantages of a waterbed include requirements for sturdy structure to support their massive filled weight and for electric heaters which can warm their otherwise chilly water fill.

The object of this invention, therefore, is to provide an improved structure for supporting objects on a fluid medium.

SUMMARY OF THE INVENTION

The invention is a support structure for use with a fluid medium and including a base for disposition in a given position; first and second buoys both buoyant in the fluid medium, the first buoy adapted for support by the fluid medium in another position displaced from the given position, and the second buoy adapted for support by the fluid medium in a different position displaced from both the given and another positions; an anchor mechanism securing the base to the first buoy so as to permit closure movement therebetween while maintaining a given maximum displacement therebetween; and a mooring mechanism securing the first buoy to the second buoy and adapted to maintain a predetermined maximum spacing therebetween while permitting relative closure movement therebetween. In preferred use, the second buoy defines an engagement surface for engaging an object and responding to forces applied thereby in directions substantially normal to the engagement surface, and the anchor and mooring mechanism are adapted to permit the closure movements in the directions of the applied forces.

In a featured embodiment of the invention, each of the buoys comprises an array of buoy portions each buoyant in the fluid medium and a connector mechanism connecting adjacent buoy portions. The connector mechanism is adapted to permit relative movement between the adjacent buoy portions in the normal direction of applied forces while maintaining certain maximum spacings therebetween in directions transverse thereto and the mooring mechanism comprises a plurality of individual moorings, each secured to different ones of the buoy portions. The buoy portions resist intrusion by a supported object without generating any sizable tangential force component.

According to one feature of the invention, the mooring mechanism comprises intermediate buoys buoyant in the fluid medium and secured between the first and second buoys, and the mooring mechanism is adapted to limit in the normal direction the maximum displacement between the intermediate buoys and each of the first and second buoys while permitting relative movement therebetween in the normal directions. The intermediate buoys enhance the operational flexability of the support structure.

In a featured embodiment of the invention, each array is two-dimensional; each buoy portion is a discrete buoy; and the connector, anchor and mooring mechanisms comprise flexible strands. In this arrangement, the buoys are adapted for submersion in a body of the fluid medium.

In one type of the above featured embodiment each discrete buoy is a solid buoy that is buoyant in water. This structure is ideally suited for supporting a person in a body of water such as a pool or lake.

In another type of the above featured embodiment each discrete buoy is a hollow shell substantially impermeable to a support fluid lighter than air, the mooring mechanism comprises flexible tubes providing fluid communication between the hollow shells, the base comprises a hollow body substantially impermeable to the support fluid, and the anchor mechanism comprises flexible tubes providing fluid communication between the body and the hollow shells of the first buoy. This structure facilitates a highly cushioned support of a person in air.

According to another featured embodiment of the invention, the first buoy comprises a first sheet partially formed by the buoy portions, the second buoy comprises a second sheet partially formed by the buoy portions, the anchor and mooring mechanism comprises flexible strands connected to the buoy portions of the first and second sheets, the first sheet partially defines a first chamber for receiving one portion of the fluid medium, and the second sheet partially defines a second chamber for receiving another portion of the fluid medium. This embodiment provides highly cushioned variable suspension of a person on the buoy sheets that are supported by fluid pressure in the first and second chambers.

According to one feature of the above embodiment, the mooring mechanism comprises intermediate buoy means buoyant in the fluid medium and secured between the first and second buoys, the intermediate buoy means comprises an intermediate sheet partially formed by an array of buoy portions and partially defining an intermediate chamber for receiving an intermediate portion of the fluid medium, and the mooring means is adapted to limit in the normal directions the maximum displacement between the intermediate buoy means and each of the first and second buoys while permitting relative movement therebetween in the normal directions. The intermediate buoy means provides a more gradual increase in the cushioning provided by this embodiment.

According to yet another feature of the invention, the above embodiment includes a distribution system for producing a first pressure of the fluid medium in the first chamber, a lower pressure of the fluid medium in the second chamber, and a pressure intermediate the first and lower pressures in the intermediate chamber. This arrangement of fluid pressure distribution enhances the level of comfort provided by the support structure.

According to still another feature of the invention, the pressure distribution system comprises a plurality of gas pumping systems each communicating with a different one of the first, second and intermediate chambers; and each of the pumping systems is adapted to provide a different fluid pressure. This distribution system is particularly well suited for use with a gaseous fluid medium.

In modification of the above embodiment, the pressure distribution system comprises a liquid reservoir and a plurality of liquid supply pipes, each of the pipes is connected to provide liquid communication between a different one of the chambers and a different outlet from the reservoir, and each of the different outlets is positioned at a different level. This distribution system is particularly suited for use with a liquid fluid medium.

DESCRIPTION OF THE DRAWINGS

These and other objects and features of the invention will become more apparent upon a perusal of the following description taken in conjunction with the accompanying drawings wherein:

FIG. 4 is a perspective view of a embodiment shown in FIG. 3 with a modified fluid supply;

FIG. 5 is a perspective view of the support structure embodiment shown in FIG. 3 with another modified fluid supply;

DESCRIPTION OF THE PREFERRED EMBODIMENT

Figure 1:
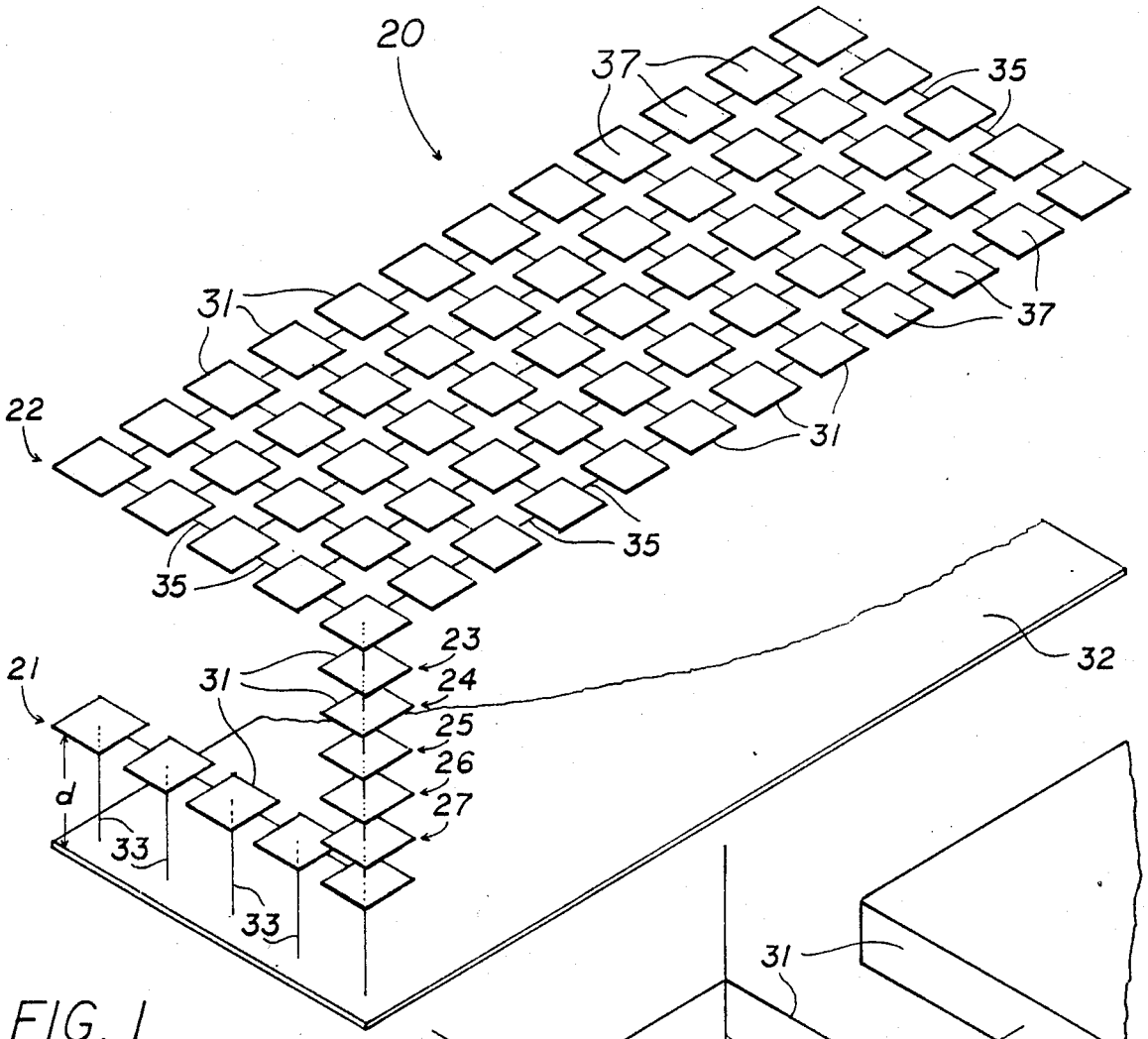
FIG. 1 is a perspective view of one support structure embodiment of the invention.
Figure 2:
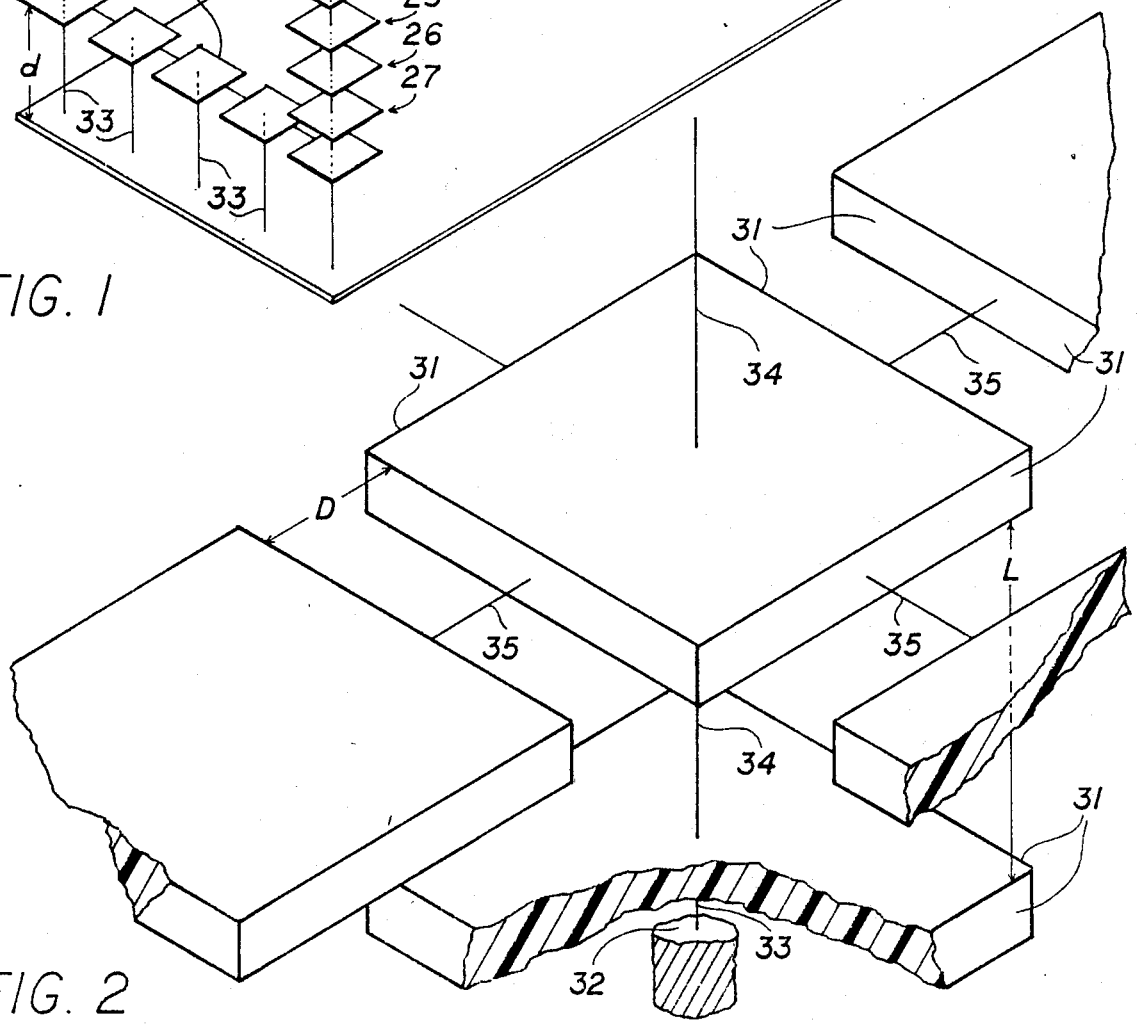
FIG. 2 is a perspective drawing showing in greater detail a portion of the support structure shown in FIG. 1.

The support structure 20 shown in FIGS. 1 and 2 includes a first composite buoy 21 and a second composite buoy 22 spaced therefrom. Disposed between and joining the first and second composite buoys 21, 22 are a plurality of spaced apart, interconnected intermediate composite buoys 23–27. Each of the composite buoys 21–27 is formed by a two-dimensionally spaced apart array of buoy portions each constituting a discrete buoy 31 buoyant in a predetermined fluid medium such as water. The first composite buoy 21 and each of the intermediate, composite buoys 23–27 are identical to the second composite buoy 22 but are only partly shown in FIG. 1 in the interest of clarity. Also included in the support structure 20 is a base 32 connected to the first composite buoy 21 and made of a material that is naturally submersible in the predetermined fluid medium.

As partially shown in FIG. 2, each of the buoys 31 in each of the arrays 21–27 is a solid member made of a suitable low density material, such as wood or plastic, that is buoyant in the predetermined fluid medium such as water. The base 32, however, is a solid member made of a relatively dense material, such as metal, that is naturally submersible in the predetermined fluid medium. Connecting each buoy 31 in the first buoy array 21 to the base 32 is an anchor strand 33 that is highly flexible but relatively non-elastic. The anchor strands 33 maintain a given maximum displacement d between the base 32 and each of the buoys 31 in the first buoy array 21 while permitting therebetween a relative closure movement that will reduce the maximum displacement d. Similarly connecting each of the buoys 31 in each of the buoy arrays 21–27 to each directly adjacent buoy 31 in an adjacent buoy array is a highly flexible and relatively non-elastic mooring strand 34. The mooring strands 34 maintain a predetermined maximum spacing L between buoys 31 in each array 21–27 and vertically adjacent buoys 31 in directly adjacent buoy arrays while permitting relative closure movement therebetween to less than the predetermined spacing L.

Joining each of the buoys 31 in each of the buoy arrays 21–27 to each directly adjacent buoy therein is a highly flexible and relatively non-elastic connector strand 35. The connector strands 35 maintain in each array 21–27 a given maximum transverse spacing D between adjacent buoys 31 while providing therebetween a low modulus of rigidity in a direction normal to the planes defined by the buoy arrays 21–27. Typically, when positioned in a fluid medium such as water, the buoy arrays 21–27 will lie in horizontal planes and the connector strands 35 will limit maximum horizontal spacing between adjacent buoys 31 in each array while permitting there between shearing movement without the application of any substantial tangential forces between adjacent buoys.

During preferred use, the support structure 20 is placed in a body of water such as a lake, a pool, or the like. The non-buoyant base 32 will sink into a given position within the fluid medium determined by the bottom thereof. Once the support structure 20 is disposed within the fluid medium, the top surfaces 37 of the buoys 31 in the second buoy array 22 together form a substantially planar engagement surface for engaging and supporting in the fluid medium an object such as a person. Each buoy 31 in the second buoy array 22 that is contacted by the supported object will respond to forces applied thereby in directions normal to its surface 37. Sinking of an individual buoy 31 in the second buoy array 22 will produce a closure movement L relative to a vertically adjacent buoy in the buoy array 23. The resultant engagement between the pair of vertically adjacent buoys will provide for the supported object their combined buoyancy. Similarly, further force induced vertical displacement of any vertical column of the buoys 31 will result in increasing buoyancy for resisting still further downward displacement of the supported object until a balance is achieved between applied force and the combined buoyancy of all contacted buoys. Thus, for example, the torso portion of a person supported on the second array 22 would cause downward movement and engagement between a substantially greater number of vertically aligned buoys 32 before a force balance was obtained than would a lighter body portion such as a foot. The overall effect of the support structure 20, therefore, is to provide for discrete portions of a supported object a level of buoyancy or resistance to submersion in the fluid medium that is directly dependent upon the weight of that discrete portion and resulting in a highly desirable variable cushioning characteristic.

Figure 3:
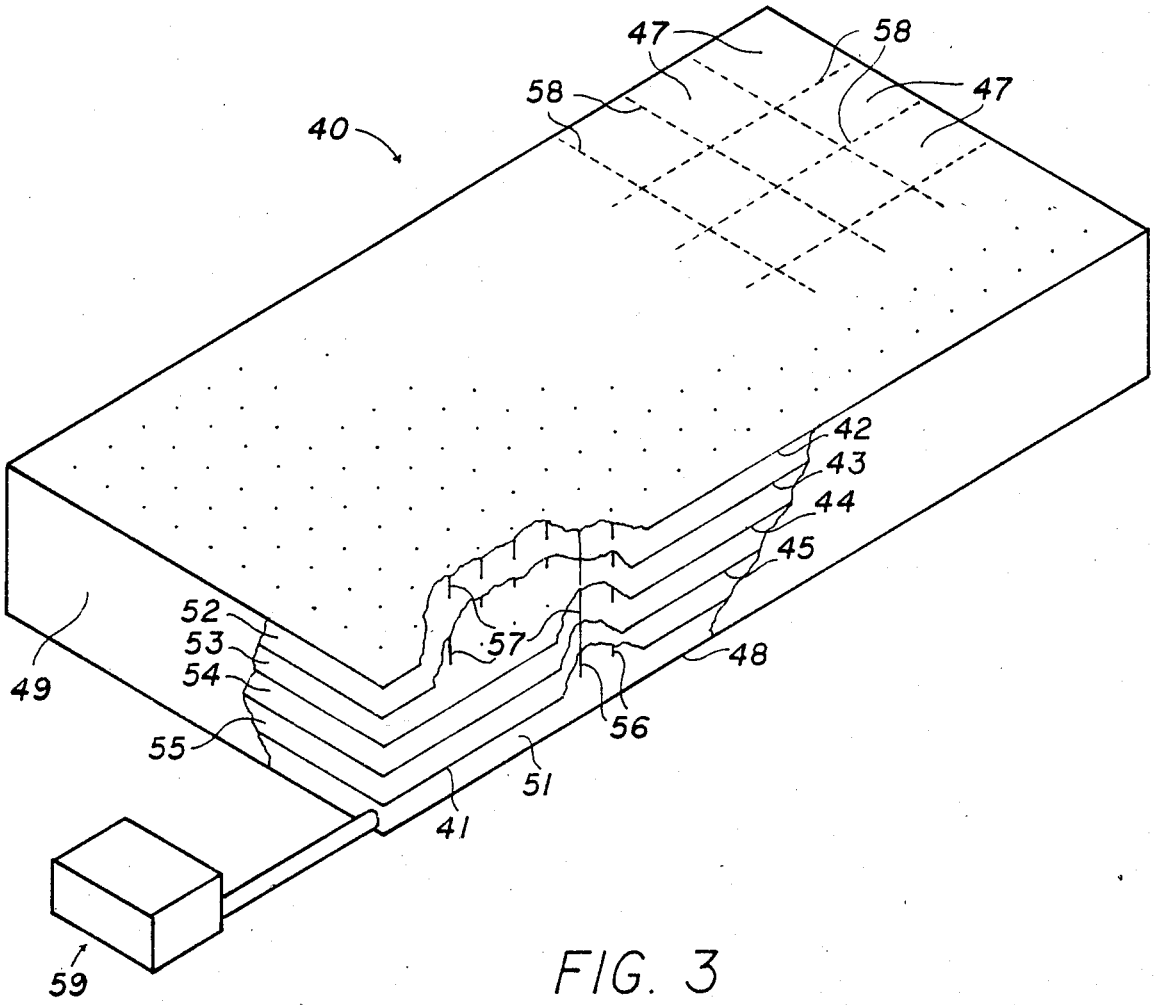
FIG. 3 is a perspective view of another support structure embodiment of the invention.

Referring now to FIG. 3, there is shown another support structure embodiment 40 of the invention. Included in the embodiment 40 is a first composite buoy 41 and a second composite buoy 42 spaced therefrom. Disposed between and joining the first and second composite buoys 41, 42 are a plurality of spaced apart, interconnected intermediate composite buoys 43–45. Each of the composite buoys 41–45 is formed by a plurality of two-dimensionally spaced apart buoy portions 47 each constituting a section of a sheet of flexible material having a relatively low modulus of rigidity. Also included in the support structure 40 is a base 48 connected to the first composite buoy 41 and also made of sheet material. Sealed to edges of the buoy sheets 41–45 and the base sheet 48 is a flexible cover sheet 49 that determines peripheral spacing between the buoy sheets 41–45. The cover sheet 49 forms with the base sheet 48 and the first buoy sheet 41 a first chamber 51; with the buoy sheets 42, 43 a second chamber 52; and with the other buoy sheets 43–45 a plurality of intermediate chambers 53–55.

Connecting each buoy portion 47 in the first buoy sheet 41 to the base sheet 48 is an anchor strand 56 that is highly flexible but relatively non-elastic. The anchor strands 56 maintain a given maximum displacement between the base sheet 48 and each of the buoy portions 47 in the first buoy sheet 41 while permitting therebetween a relative closure movement that will reduce that maximum displacement. Similarly connecting each of the buoy portions 47 in each of the buoy sheets 41–45 to each directly adjacent buoy portion 47 in an adjacent buoy sheet is a highly flexible and relatively non-elastic mooring strand 57. The mooring strands 57 maintain a predetermined maximum spacing between buoy portions 47 in each of the directly adjacent buoy sheets while permitting relative closure movement therebetween to less than that predetermined spacing.

Joining each of the buoy portions 47 in each of the buoy sheets 41–45 are connector portions 58 thereof. The connector portions 58 maintain for each buoy sheet 41–45 a given maximum transverse spacing between adjacent buoy portions 47 while exhibiting therebetween a low modulus of rigidity in a direction normal to the planes defined by the buoy sheets 41–45. Typically, when the base sheet is positioned on a flat surface and the chambers 51–55 are filled with a fluid medium such as air, the buoy sheets 41–45 will lie in horizontal planes and the connector portions 58 will limit maximum horizontal spacing between adjacent buoy portions 47 in each sheet 41–45 while permitting relative vertical, shearing movement therebetween and without the application of any substantial tangential forces between adjacent buoy portions. Preferably, the base sheet 48 and the cover sheet 49 are substantially impermeable to a predetermined fluid medium such as air while the first and second sheets 41, 42 and the intermediate sheets 43–45 are slightly permeable thereto. In addition, a fluid pump 59 is connected for fluid communication with the first chamber 51. Thus, activation of the pump 59 quickly fills the first chamber 51 with fluid medium and the other chambers 52–55 are subsequently filled by fluid permeating through the sheets 41 and 43–45. Because of the distribution arrangement, the fluid pressure produced in the first chamber 51 is greater than the fluid pressure produced in the second chamber 52 and the fluid pressures produced in the intermediate chambers 53–55 are intermediate to those extreme high and low fluid pressures.

During preferred use, the base sheet 48 is placed in a given position on a flat surface and the pump 59 is activated to pressurize the chambers 51–55 and provide buoyant support for the sheets 41–45. Once the support structure 20 is filled with the fluid medium, the buoy portions of the second sheet 42 together form a substantially planar engagement surface for engaging and supporting on the fluid medium an object such as a person. Each buoy portion 47 in the second buoy sheet 42 that is contacted by the supported object will respond by sinking in the fluid medium a vertical distance determined primarily by the magnitude of the forces applied in a direction normal to its upper surface. When an individual buoy portion 47 in the second buoy sheet 42 is displaced downwardly by a certain distance, a vertically adjacent buoy portion in the buoy sheet 43 will be contacted thereby providing for the supported object the increased support provided by the higher fluid pressure in the intermediate chamber 53. Similarly, further force induced vertical displacement of any vertical column of the buoy portions 47 will result in increasing buoyancy for resisting still further downward displacement of the support object because of the downwardly increasing fluid pressures in the chambers 54, 55 and 51. Thus, the overall effect of the support structure 40 is to provide for discrete portions of a supported object a level of buoyancy or fluid medium support that is directly dependent upon weight of that discrete portion and resulting in a highly desirable support characteristic.

FIG. 4 illustrates a modified distribution system 60 for use with the support structure embodiment 40 of FIG. 3. The system 60 includes a plurality of gas pumps 61–65 each adapted to provide a progressively lower gas pressure. Connecting each of the fluid pumps 61–65 to, respectively, the fluid chamber 51, 55, 54, 53 and 52 are gas tubes 66. In this arrangement, all of the buoy sheets in the support structure 40 preferably are impermeable to the predetermined fluid medium such as air and the desired differential pressures in the chambers 51–55 are established by the individual fluid pumps 61–65 of different outlet pressure capacity or alternatively by a single pump connected in parallel with a plurality of regulators each adjusted to a different output pressure.

FIG. 5 shows another fluid distribution system 70 for use with the support embodiment 40 shown in FIG. 3. The system 70 includes a plurality of fluid reservoirs 122–126 for receiving a suitable liquid such as water. A plurality of feed tubes 72–76 have individual ends, respectively, connected to outlets from the tanks 122–126 at progressively higher elevations. Opposite ends of the feed tubes 72–76, respectively, are connected for liquid communication with the second chamber 52, the intermediate chambers 53–55 and the first chamber 51. Again, the buoy sheets 41–45 are substantially impermeable to the selected liquid such as water and the gravity induced differential pressure levels in the reservoirs 122–126 are transferred to the chambers 51–55 in the support structure 40 by the feed tubes 72–76.

Figure 6:
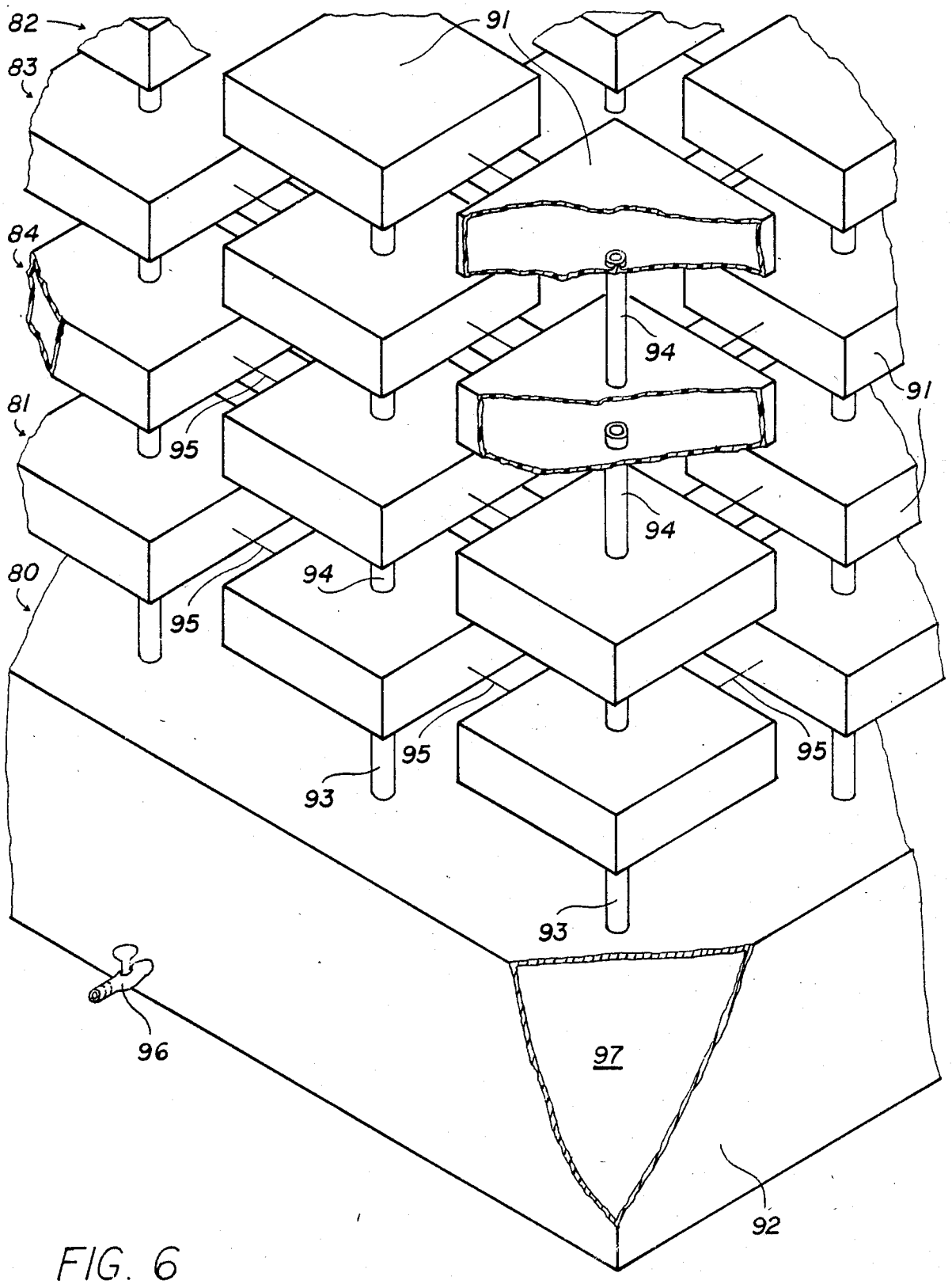
FIG. 6 is a perspective view of another support structure embodiment of the invention.

Illustrated in FIG. 6 is another support structure embodiment 80 including a first composite buoy 81 and a second composite buoy 82 spaced therefrom. Disposed between and joining the first and second composite buoys 81, 82 are a pair of spaced apart, interconnected intermediate composite buoys 83, 84. Each of the composite buoys 81–84 is formed by a two-dimensionally spaced apart array of buoy portions each constituting a discrete buoy 91 adapted for buoyancy in a predetermined fluid medium such as air. Also included in the support structure 80 is a base 92 that is connected to the first composite buoy 81.

As partially shown in FIG. 6, each of the buoys 91 in each of the arrays 81–84 is a hollow shell made of a suitable light, low density material that is impermeable to a predetermined support fluid such as helium gas.

The base 92 similarly is a hollow body impermeable to the support fluid but made of a relatively heavy material. Connecting each buoy 91 in the first buoy array 81 to the base 92 is an anchor tube 93 that is highly flexible but relatively non-elastic. The anchor tubes 93 maintain a given maximum displacement between the base 92 and each of the buoys 91 in the first buoy array 81 while permitting therebetween a relative closure movement that will reduce that maximum displacement. Similarly connecting each of the buoys 91 in each of the buoy arrays 81–84 to each directly adjacent buoy 91 in an adjacent buoy array is a highly flexible and relatively non-elastic mooring tube 94. The mooring tubes 94 maintain a predetermined maximum spacing between buoys 91 in each array 81–84 and vertically adjacent buoys 91 in directly adjacent buoy arrays while permitting relative closure movement therebetween to less than that predetermined spacing.

Joining each of the buoys 91 in each of the buoy arrays 81–84 to each directly adjacent buoy therein are highly flexible and relatively nonelastic connector strands 95. The connector strands 95 maintain in each array 81–84 a given maximum transverse spacing between adjacent buoys 91 while providing therebetween a low modulus of rigidity in a direction normal to the planes defined by the buoy arrays 81–84. Typically, when filled with a support fluid such as helium gas, the buoy arrays 81–84 will lie in horizontal planes and the connector strands 95 will limit maximum horizontal spacing between adjacent buoys 91 in each array while permitting therebetween shearing movement without the application of any substantial tangential forces between adjacent buoys. With the base 92 positioned on a suitable surface and the hollow buoys 91 filled with helium gas via an inlet 96 to the base 92, the gas reservoir 97 therein, and the feed tubes 94, the structure 80 will provide a highly cushioned variable support characteristic in the same manner as described above for the embodiment 20 of FIGS. 1 and 2.

Figure 7:
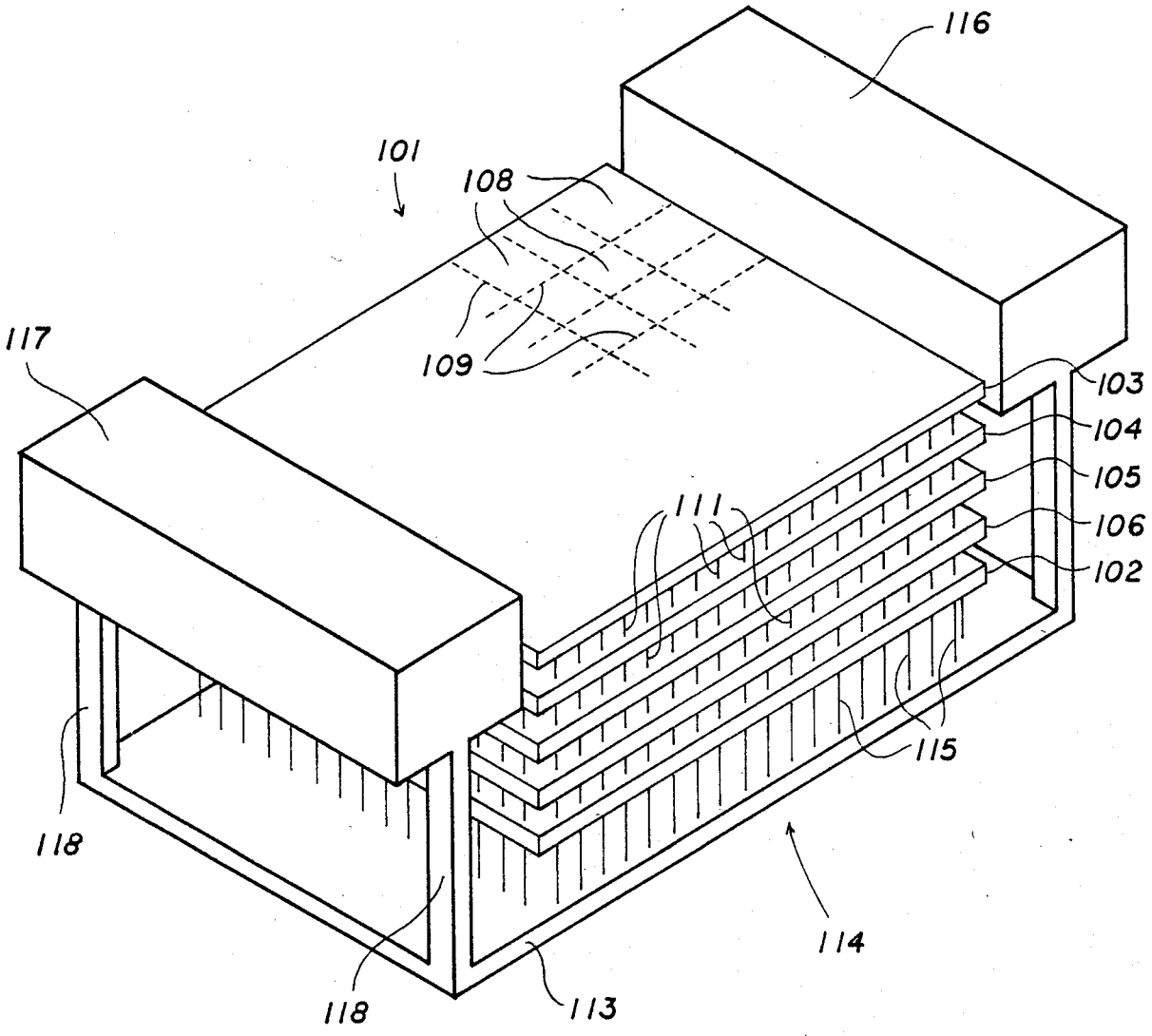
FIG. 7 is a partially perspective view of another support structure embodiment of the invention.

Illustrated in FIG. 7 is another support structure embodiment 101 of the invention which combines features exhibited in both the embodiment 20 of FIGS. 1 and 2 and the embodiment 40 of FIG. 3. A first buoyant mat 102 is joined to a second buoyant mat 103 by a mooring structure that includes a plurality of spaced apart intermediate buoy mats 104–106. Each of the buoy mats is made of a material buoyant in a particular fluid medium such as water and having a relatively low modulus of rigidity. Composing each of the mats 102–106 are two-dimensionally spaced apart buoy portions 108 joined by connector portions 109. As in the embodiment 40 of FIG. 3, each of buoy portions 108 in each of the buoy mats 102–106 is joined to a vertically adjacent buoy portion of an adjacent buoy mat by a highly flexible but relatively non-elastic mooring strand 111. Similarly each buoy portion 108 of the first buoy mat 102 is connected to a base portion 113 of a dock 114 by a flexible and relatively non-elastic anchor strand 115. Also included in the dock 114 are a pair of spaced apart float portions 116, 117 disposed on opposite sides and slightly elevated above the second buoy mat 103 and joined to the base portion 113 by columns 118.

The dock 114 is constructed of a material that is naturally submersible in the predetermined fluid medium such as water. The weight of the dock 114 preferably is selected with relation to the buoyancy of the buoy mats 102–106 such that when positioned in a body of the predetermined fluid medium such as water, the base portion 113 of the dock 114 will assume a given submerged position that retains the buoy mats 102 and 104–106 in vertically spaced apart submerged positions within the liquid body while the second buoy mat 103 is retained at substantially the surface thereof. An object such as a person can then be supported on the upper surface of the second buoy mat 103 in the same desirable fashion as described above in connection with the embodiments of FIG. 1–3.

Obviously, many modifications and variations of the present invention are possible in light of the above teachings. For example only, the various embodiments can be used in slightly altered form for applications other than those specifically described including furniture, building foundations, vertically oriented abutments, etc. It is to be understood, therefore, that the invention can be practiced otherwise than as specifically described.

What is claimed is:

1. A support structure for use with a fluid medium and comprising:

a base means for disposition in a given position;

a first buoy means and a second buoy means each comprising an array of buoy portions each buoyant in the fluid medium and connector means connecting adjacent buoy portions in said array, said first buoy means adapted to be supported by the fluid medium in another position displaced from said given position, said second buoy means adapted to be supported by the fluid medium in a different position displaced from both said given and another positions, and said connector means being adapted to permit relative movement between said adjacent buoy portions in direction, substantially normal thereto while maintaining certain maximum spacings therebetween in directions transverse to said normal directions;

anchor means securing said base means to said first buoy means and adapted to permit closure movement therebetween and to maintain a given maximum displacement therebetween; and mooring means securing said first buoy means to said second buoy means, said mooring means adapted to maintain a predetermined maximum spacing between said first and second buoy means and to permit relative closure movement therebetween.

2. A support structure according to claim 1 wherein said second buoy means defines an engagement surface for engaging an object and responding to forces applied thereby to said engagement surface in said substantially normal directions, and said anchor means and said mooring means are adapted to permit said closure movements in the directions of said applied forces.

3. A support structure according to claim 1 wherein said mooring means comprises a plurality of individual moorings, each secured to a different one of said buoy portions.

4. A support structure according to claim 3 wherein each of said buoy portions is a discrete buoy.

5. A support structure according to claim 4 wherein said connector means, said anchor means and said mooring means comprise flexible strands.

6. A support structure according to claim 4 wherein each said discrete buoy is a hollow shell substantially impermeable to a support fluid lighter than air.

7. A support structure according to claim 6 wherein said mooring means comprise flexible tubes providing fluid communication between said hollow shells.

8. A support structure according to claim 7 wherein said base means comprises a hollow body substantially impermeable to said support fluid, and said anchor means comprise flexible tubes providing fluid communication between said body and said hollow shells of said first buoy means.

9. A support structure according to claim 3 wherein each of said arrays is adapted for disposition in a plane substantially transverse to said normal directions.

10. A support structure according to claim 9 wherein each of said buoy portions is a discrete buoy, and said connector means, said anchor means and said mooring means comprise flexible strands.

11. A support structure according to claim 3 wherein each of said arrays is a two dimensional array.

12. A support structure according to claim 2 wherein said mooring means comprises intermediate buoy means buoyant in the fluid medium and secured between said first and second buoy means, and said mooring means is adapted to limit in said normal direction the maximum displacement between said intermediate buoy means and each of said first and second buoy means while permitting relative movement therebetween in said normal directions.

13. A support structure according to claim 12 wherein said anchor means and said mooring means comprise flexible strands.

14. A support structure according to claim 13 wherein each of said buoy means comprises an array of buoy portions each buoyant in the fluid medium and connector means connecting adjacent buoy portion in said array, and said connector means is adapted to permit relative movement between said adjacent buoy portions in said normal direction while maintaining certain maximum spacings therebetween in directions transverse to said normal directions.

15. A support structure according to claim 14 wherein each of said buoy portions is a discrete buoy.

16. A support structure according to claim 15 wherein each said discrete buoy is a solid buoy and the fluid medium is water.

17. A support structure according to claim 1 wherein said buoy portions comprise in each of first and second buoy means peripheral buoy portions that define an outer periphery thereof and internal buoy portions displaced from said peripheral buoy portions and located within said periphery, and said mooring means is secured to each of said peripheral and internal buoy portions.

* * * * *